US008833408B1

(12) United States Patent
Price

(10) Patent No.: US 8,833,408 B1
(45) Date of Patent: Sep. 16, 2014

(54) WALLET SYSTEM

(76) Inventor: Buddy A. Price, Oakland Park, FL (US)

( * ) Notice: Subject to any disclaimer, the term of this patent is extended or adjusted under 35 U.S.C. 154(b) by 405 days.

(21) Appl. No.: 13/239,866

(22) Filed: Sep. 22, 2011

(51) Int. Cl.
*A45C 1/06* (2006.01)

(52) U.S. Cl.
USPC ..... 150/145; 150/131; 150/138

(58) Field of Classification Search
USPC ..... 150/131–132, 139–140, 145–147, 150, 150/138
See application file for complete search history.

(56) References Cited

U.S. PATENT DOCUMENTS

| | | | | | |
|---|---|---|---|---|---|
| 814,205 | A * | 3/1906 | Hawes | 150/149 |
| 1,545,577 | A * | 7/1925 | Arms | 150/147 |
| D128,260 | S * | 7/1941 | Hennings | D3/319 |
| 3,118,478 | A * | 1/1964 | Metrick | 150/136 |
| 3,777,795 | A | 12/1973 | Graetz | |
| 3,882,916 | A * | 5/1975 | Margolis | 150/132 |
| 3,946,781 | A | 3/1976 | Reis | |
| D278,445 | S * | 4/1985 | Hartney | D19/26 |
| 6,039,175 | A * | 3/2000 | Wright | 206/37 |
| 6,923,229 | B2 * | 8/2005 | Beckley | 150/138 |
| 7,556,073 | B2 | 7/2009 | Lyons | |
| D608,092 | S | 1/2010 | Holzner et al. | |
| D641,551 | S * | 7/2011 | Deinert | D3/247 |
| 2009/0288746 | A1 | 11/2009 | Baca | |
| 2010/0078100 | A1 * | 4/2010 | Orton | 150/134 |

* cited by examiner

*Primary Examiner* — Tri Mai

(57) ABSTRACT

A wallet system having an elongated panel with a first end and a second end, wherein a fold is in the panel about halfway between the first and second end and extends from the top edge to the bottom edge, the fold divides the panel into a first half panel and a second half panel, wherein the panel can pivot about the fold between an open and closed position, a first and second pouch both on the front surface of the first half panel, and a third and fourth pouch both on the front surface of the second half panel, the first pouch has a thickness greater than that of the fourth pouch, and the third pouch has a thickness greater than that of the second pouch, each pouch having an to provide access to the pouch.

13 Claims, 3 Drawing Sheets

(Inside View)

(Side View)

Inside View)

(Side View)

(Side View)

(ISO View)

WALLET SYSTEM

FIELD OF THE INVENTION

The present invention is directed to a novel wallet.

BACKGROUND OF THE INVENTION

Some individuals prefer not to carry loose change or much cash with them in their wallets. The present invention features a novel wallet system. The wallet system of the present invention allows a user to carry credit cards, debit cards, identification cards, and/or pictures, as well as paper currency. The identification cards (e.g., licenses) or pictures are visible. The wallet system of the present invention does not get thick or bulge.

SUMMARY

The present invention features a wallet system. In some embodiments, the wall system comprises an elongated panel having a first end a second end, a top edge, a bottom edge, a front surface, and a back surface, wherein a fold is disposed in the panel about halfway between the first end and the second end and extends from the top edge to the bottom edge, the fold divides the panel into a first half panel and a second half panel, wherein the panel can pivot about the fold between an open position and a closed position; a first pouch and a second pouch both disposed on the front surface of the first half panel, and a third pouch and a fourth pouch both disposed on the front surface of the second half panel, wherein the pouches are arranged such that when the system is in the closed position the first pouch contacts the fourth pouch and the second pouch contacts the third pouch, the first pouch has a thickness greater than that of the fourth pouch, and the third pouch has a thickness greater than that of the second pouch; and a first opening slot disposed in the first pouch to provide access to the first pouch, a second opening slot disposed in the second pouch to provide access to the second pouch, a third opening slot disposed in the third pouch to provide access to the third pouch, and a fourth opening slot disposed in the fourth pouch to provide access to the fourth pouch.

In some embodiments, the second pouch is clear, translucent, or transparent. In some embodiments, the fourth pouch is clear, transparent, or translucent.

In some embodiments, the first opening slot is aligned with the first end of the panel and extends from near the top edge to near the bottom edge of the panel. In some embodiments, the first opening slot faces the fold. In some embodiments, the second opening slot is aligned with the top edge of the panel. In some embodiments, the second opening slot faces the top edge of the panel. In some embodiments, the third opening slot is aligned with the first end of the panel and extends from near the top edge to near the bottom edge of the panel. In some embodiments, the third opening slot faces the fold. In some embodiments, the fourth opening slot is aligned with the top edge of the panel. In some embodiments, the fourth opening slot faces the top edge of the panel. In some embodiments, each opening slot comprises an indentation.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
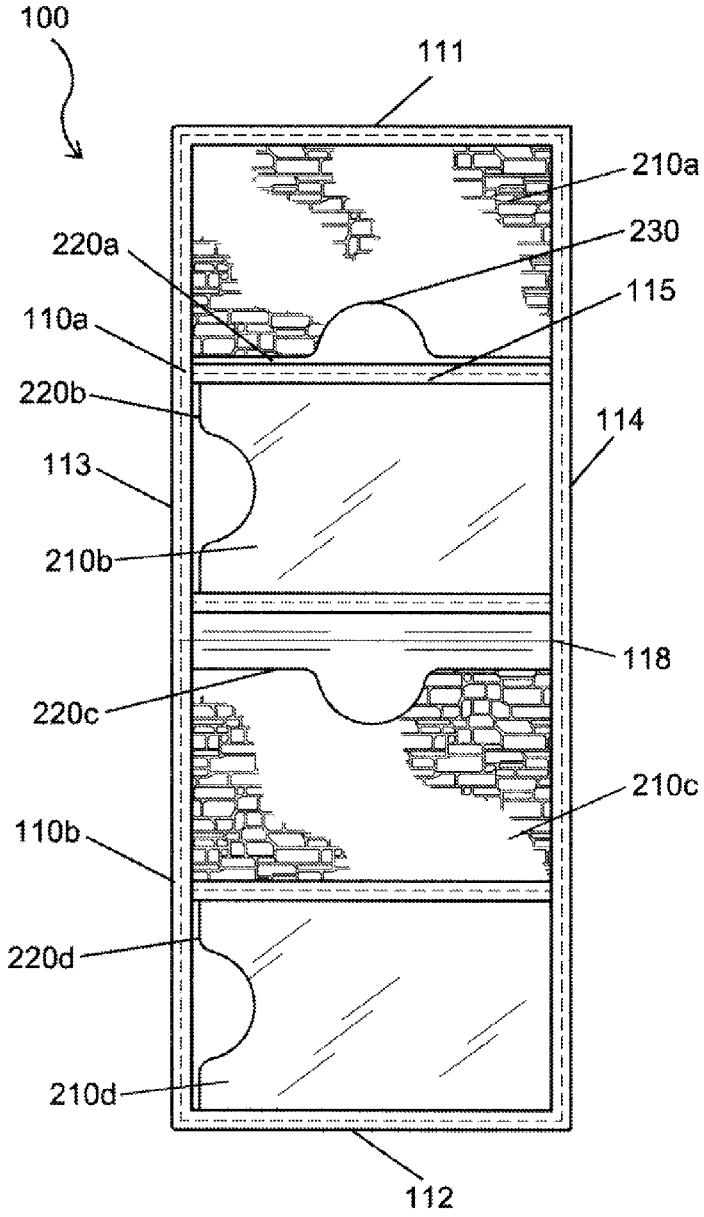
FIG. 1 is a front view of the system of the present invention, wherein the system is in the open position.
Figure 2:
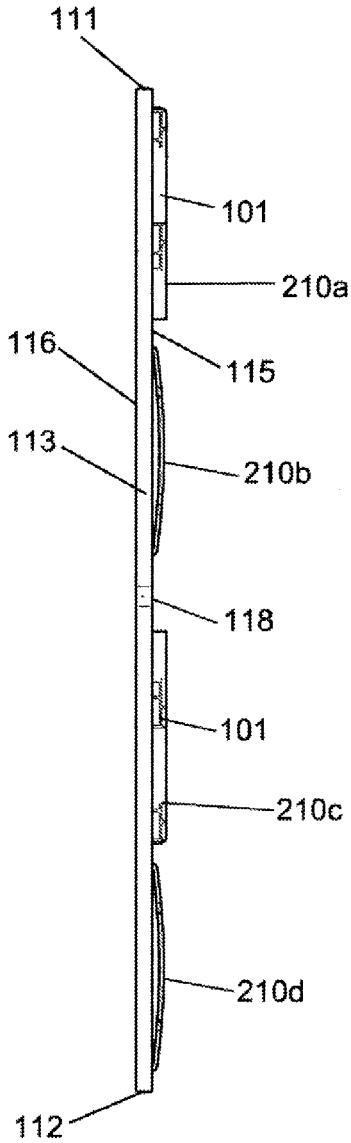
FIG. 2 is a side view of the system of the present invention, wherein the system is in the open position.

Referring now to FIG. 1-4, the present invention features a wallet system 100. The wallet system 100 comprises an elongated panel 110 having a first end 111*a* second end 112, a top edge 113, a bottom edge 114, a front surface 115 (e.g., an inside surface) and a back surface 116 (e.g., an outer surface). A fold 118 is disposed in the panel 110 about halfway between the first end 111 and the second end 112. The fold 118 extends from the top edge 113 to the bottom edge 114. The fold 118 divides the panel 110 into a first half panel 110*a* and a second half panel 110*b*.

Figure 3:
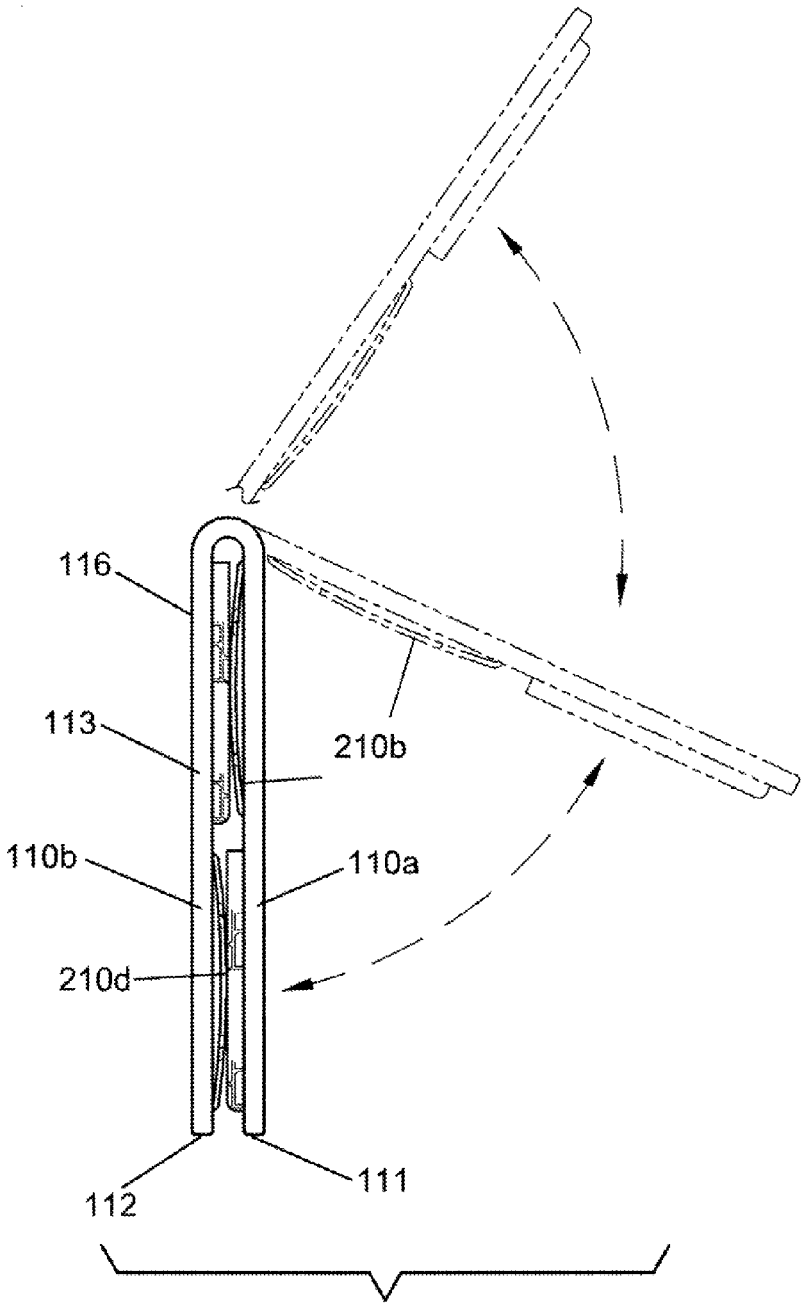
FIG. 3 is a side view of the system of the present invention, wherein the system is in the dosed position.
Figure 4:
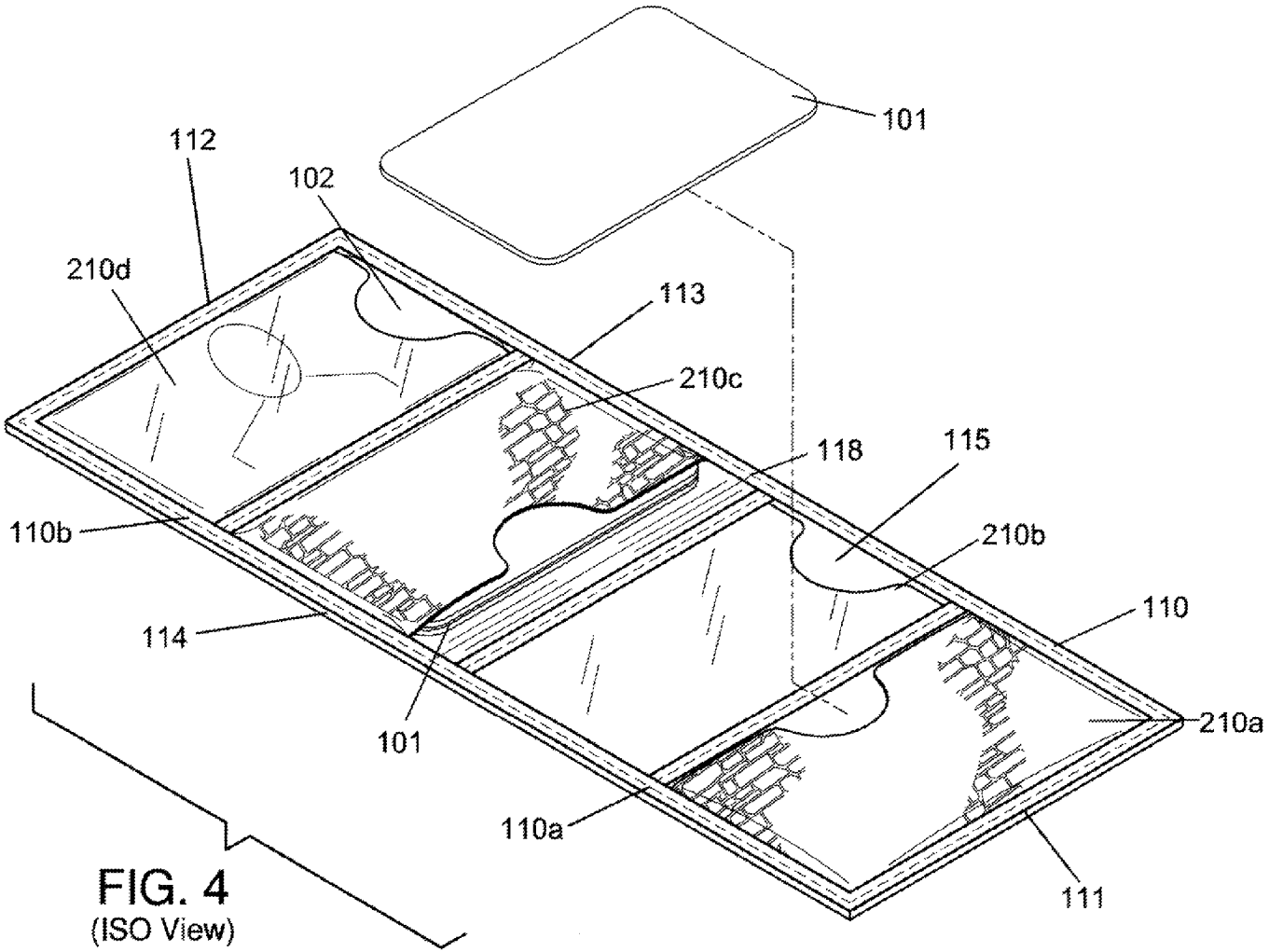
FIG. 4 is a perspective and in-use view of the system of the present invention.

The panel 110 can fold or pivot about the fold 118. As shown in FIG. 1 and FIG. 3, the system 100 can pivot between an open position (e.g., shown in FIG. 1) and a closed position (e.g., shown in FIG. 3) via the fold 118. In the dosed position, the first end 111 and second end 112 are pivoted toward each other and the front surfaces 115 of the half panels 110*a*, 110*b* are in contact with each other.

Disposed on the front surface 115 of the first half panel 110*a* are a first pouch 210*a* and a second pouch 210*b*. Disposed on the front surface 115 of the second half panel 110*b* are a third pouch 210*c* and a fourth pouch 210*d*. In some embodiments, the first pouch 210*a* is thick (e.g., leather). In some embodiments, the second pouch 210*b* is generally clear, transparent, or translucent (e.g., plastic, thin plastic). In some embodiments, the third pouch 210*c* is thick (e.g., leather). In some embodiments, the fourth pouch 210*d* is generally clear, transparent, or translucent (e.g., plastic, thin plastic). In some embodiments, the first pouch 210*a* and/or the third pouch 210*c* is used for storing credit cards 101 or debit cards. In some embodiments, the second pouch 210*b* and/or the fourth pouch 210*d* is used for storing ID cards 102 or photos. The pouches 210 are arranged such that when the system 100 is in the closed position (e.g., as shown in FIG. 3), the first pouch 210*a* contacts the fourth pouch 210*d* and the second pouch 210*b* contacts the third pouch 210*c*. The first pouch 210*a* has a thickness greater than that of the fourth pouch 210*d*, and the third pouch 210*c* has a thickness greater than that of the second pouch 210*b*.

The first pouch 210*a* has a first opening slot 220*a*, which provides access to the first pouch 210*a* and allows a user to insert a card (e.g., ID card, credit card, debit card) or photo into the first pouch 210*a*. In some embodiments, the first opening slot 220*a* is aligned with the first end 111 of the panel 110 (e.g., extending from near the top edge 113 to near the bottom edge 114 of the panel 110. In some embodiments, the first opening slot 220*a* faces the fold 118. The second pouch 210*b* has a second opening slot 220*b*, which provides access to the second pouch 210*b* and allows a user to insert a card (e.g., ID card, credit card, debit card) or photo into the second pouch 210*b*. In some embodiments, the second opening slot 220*b* is aligned with the top edge 113 of the panel 110. In some embodiments, the second opening slot 220*b* faces the top edge 113 of the panel 110 (e.g. perpendicular to the first opening slot 220*a*).

The third pouch 210*c* has a third opening slot 220*c*, which provides access to the third pouch 210*c* and allows a user to insert a card (e.g., ID card, credit card, debit card) or photo into the third pouch 210*c*. In some embodiments, the third opening slot 220*c* is aligned with the first end 111 (or the second end 112) of the panel 110 (e.g., extending from near the top edge 113 to near the bottom edge 114 of the panel 110. In some embodiments, the third opening slot 220*c* faces the fold 118. The fourth pouch 210*d* has a fourth opening slot 220*d*, which provides access to the fourth pouch 210*d* and allows a user to insert a card (e.g., ID card, credit card, debit card) or photo into the fourth pouch 210*d*. In some embodiments, the fourth opening slot 220*d* is aligned with the top edge 113 of the panel 110. In some embodiments, the fourth opening slot 220*d* faces the top edge 113 of the panel 110 (e.g. perpendicular to the third opening slot 220*c*).

In some embodiments, each opening slot 220 comprises an indentation 230 (e.g., curved, concave). The indentation 230 allows a user to more easily access the item in the respective pouch 210.

The system 100 of the present invention may be constructed in a variety of styles, designs, colors, and sizes.

The disclosures of the following U.S. patents are incorporated in their entirety by reference herein: U.S. Pat. No. 3,777,795; U.S. Pat. No. 3,946,781; U.S. Pat. No. 6,923,229; U.S. Pat. No. 7,556,073; U.S. Design Pat. No. 0608092; U.S. Patent Application No. 2009/0288746.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A wallet system (100) comprising:

(a) an elongated panel (110) having a first end (111) a second end (112), a top edge (113), a bottom edge (114), a front surface (115), and a back surface (116), wherein a fold (118) is disposed in the panel (110) about halfway between the first end (111) and the second end (112) and extends from the top edge (113) to the bottom edge (114), the fold (118) divides the panel (110) into a first half panel (110*a*) and a second half panel (110*b*), wherein the panel (110) can pivot about the fold (118) between an open position and a closed position; and (b) a first pouch (210*a*) and a second pouch (210*b*) both disposed on the front surface (115) of the first half panel (110*a*), and a third pouch (210*c*) and a fourth pouch (210*d*) both disposed on the front surface (115) of the second half panel (110*b*), wherein the pouches (210) are arranged such that when the system (100) is in the closed position the first pouch (210*a*) contacts the fourth pouch (210*d*) and the second pouch (210*b*) contacts the third pouch (210*c*), a substantial entire surface of the first pouch (210*a*) has a thickness greater than that of the fourth pouch (210*d*), and a substantial entire surface of the third pouch (210*c*) has at thickness greater than that of the second pouch (210*b*); and (c) a first opening slot (220*a*) disposed in the first pouch (210*a*) to provide access to the first pouch (210*a*), a second opening slot (220*b*) disposed in the second pouch (210*b*) to provide access to the second pouch (220*b*), a third opening slot (220*c*) disposed in the third pouch (210*c*) to provide access to the third pouch (220*c*), and a fourth opening slot (220*d*) disposed in the fourth pouch (210*d*) to provide access to the fourth pouch (220*d*);

wherein when the system (100) is in a closed position, the thicker first pouch (210*a*) faces the thinner fourth pouch (210*d*) and the thicker third pouch (210*c*) faces the thinner second pouch (210*b*) such that the first half panel (110*a*) and the second half panel (110*b*) are parallel to each other.

2. The system (100) of claim 1, wherein the second pouch (210*b*) is clear, translucent, or transparent.

3. The system (100) of claim 1, wherein the fourth pouch (210*d*) is clear, transparent, or translucent.

4. The system (100) of claim 1, wherein the first opening slot (220*a*) is aligned with the first end (111) of the panel (110) and extends from near the top edge (113) to near the bottom edge (114) of the panel (110).

5. The system (100) of claim 1, wherein the first opening slot (220*a*) faces the fold (118).

6. The system (100) of claim 1, wherein the second opening slot (220*b*) is aligned with the top edge (113) of the panel (110).

7. The system (100) of claim 1, wherein the second opening slot (220*b*) faces the top edge (113) of the panel (110).

8. The system (100) of claim 1, wherein the third opening slot (220*c*) is aligned with the first end (111) of the panel (110) and extends from near the top edge (113) to near the bottom edge (114) of the panel (110).

9. The system (100) of claim 1, wherein the third opening slot (220*c*) faces the fold (118).

10. The system (100) of claim 1, wherein the fourth opening slot (220*d*) is aligned with the top edge (113) of the panel (110).

11. The system (100) of claim 1, wherein the fourth opening slot (220*d*) faces the top edge (113) of the panel (110).

12. The system (100) of claim 1, wherein each opening slot (220) comprises an indentation (230).

13. A wallet system (100) consisting of:

(a) an elongated panel (110) having a first end (111) a second end (112), a top edge (113), a bottom edge (114), a front surface (115), and a back surface (116), wherein a fold (118) is disposed in the panel (110) about halfway between the first end (111) and the second end (112) and extends from the top edge (113) to the bottom edge (114), the fold (118) divides the panel (110) into a first half panel (110*a*) and a second half panel (110*b*), wherein the panel (110) can pivot about the fold (118) between an open position and a closed position; and (b) a first pouch (210*a*) and a second pouch (210*b*) both disposed on the front surface (115) of the first half panel (110*a*), and a third pouch (210*c*) and a fourth pouch (210*d*) both disposed on the front surface (115) of the second half panel (1100*b*), wherein the pouches (210) are arranged such that when the system (100) is in the closed position a substantial entire surface of the first pouch (210*a*) contacts the fourth pouch (210*d*) and the second pouch (210*b*) contacts a substantial entire surface of the third pouch (210*c*), the first pouch (210*a*) has a thickness greater than that of the fourth pouch (210*d*), and the third pouch (210*c*) has a thickness greater than that of the second pouch (210*b*); and (c) a first opening slot (220*a*) disposed in the first pouch (210*a*) to provide access to the first pouch (210*a*), a second opening slot (220*b*) disposed in the second pouch (210*b*) to provide access to the second pouch (220*b*), a third opening slot (220*c*) disposed in the third pouch (210*c*) to provide access to the third pouch (220*c*), and a fourth opening slot (220*d*) disposed in the fourth pouch (210*d*) to provide access to the fourth pouch (220*d*);

wherein when the system (100) is in a closed position, the thicker first pouch (210*a*) faces the thinner fourth pouch (210*d*) and the thicker third pouch (210*c*) faces the thinner second pouch (210*b*) such that the first half panel (110*a*) and the second half panel (110*b*) are parallel to each other.

* * * * *